US011193278B2

(12) United States Patent
Kim et al.

(10) Patent No.: US 11,193,278 B2
(45) Date of Patent: Dec. 7, 2021

(54) ANCHOR PIN FOR PLACING SHOTCRETE AND FIXING TEXTILE GRID AND METHOD OF CONSTRUCTING TEXTILE GRID REINFORCED SHOTCRETE USING THE SAME

(71) Applicant: KOREA INSTITUTE OF CIVIL ENGINEERING AND BUILDING TECHNOLOGY, Gyeonggi-do (KR)

(72) Inventors: Hyeong Yeol Kim, Gyeonggi-do (KR); Kyung Taek Koh, Gyeonggi-do (KR); Gum Sung Ryu, Gyeonggi-do (KR); Gi Hong An, Gyeonggi-do (KR); Dong Woo Seo, Gyeonggi-do (KR); Seung Seop Jin, Incheon (KR)

(73) Assignee: KOREA INSTITUTE OF CIVIL ENGINEERING AND BUILDING TECHNOLOGY, Gyeonggi-do (KR)

( * ) Notice: Subject to any disclaimer, the term of this patent is extended or adjusted under 35 U.S.C. 154(b) by 69 days.

(21) Appl. No.: 16/698,926

(22) Filed: Nov. 27, 2019

(65) Prior Publication Data

US 2021/0062508 A1 Mar. 4, 2021

(30) Foreign Application Priority Data

Sep. 4, 2019 (KR) ..... 10-2019-0109412

(51) Int. Cl.
*E04C 5/18* (2006.01)
*E04B 1/41* (2006.01)
(Continued)

(52) U.S. Cl.
CPC ..... *E04C 5/18* (2013.01); *E04B 1/41* (2013.01); *E04C 5/07* (2013.01); *E04G 23/0233* (2013.01)

(58) Field of Classification Search
CPC ..... E04G 23/0218; E04G 23/0288; E04G 23/0203; E04G 23/02; E04G 23/0211; E04G 2023/0251; E04B 1/41
See application file for complete search history.

(56) References Cited

U.S. PATENT DOCUMENTS 5,673,525 A * 10/1997 Keith ..... B28B 19/003 411/487
6,138,981 A * 10/2000 Keith ..... E04G 11/18 249/19
(Continued)

FOREIGN PATENT DOCUMENTS

KR 100454021 10/2004
KR 101169770 7/2012
(Continued)

*Primary Examiner* — Gisele D Ford
(74) *Attorney, Agent, or Firm* — JCIPRNET

(57) ABSTRACT

Provided are an anchor pin for placing shotcrete and fixing a textile grid and a method of constructing textile grid reinforced shotcrete using the same, wherein the anchor pin allows a textile grid reinforcement to be precisely disposed at a required position and, when shotcrete is placed, prevents a textile grid reinforcement from moving due to a driving pressure for precise construction so as to increase durability and safety of the concrete structure, allows primary and secondary shotcrete to be constructed while placing thicknesses thereof are visually checked so as to increase precision of construction, and allows the textile grid reinforcement to be disposed and fixed to accurately correspond to a shape of the concrete structure even when a lower portion of a slab, a wall, and a structure with a curved surface, such as a lining of a tunnel, are built.

11 Claims, 13 Drawing Sheets

(51) Int. Cl.
*E04C 5/07* (2006.01)
*E04G 23/02* (2006.01)

(56) References Cited

U.S. PATENT DOCUMENTS

| | | | | |
|---|---|---|---|---|
| 6,263,638 | B1 * | 7/2001 | Long, Sr. | B28B 23/028 52/794.1 |
| 7,266,931 | B2 * | 9/2007 | Long, Sr. | E04C 2/044 52/309.11 |
| 8,479,468 | B1 * | 7/2013 | Abbasi | E04G 23/0218 52/408 |
| 8,881,480 | B1 * | 11/2014 | Horwath | E04C 2/288 52/407.5 |
| 9,074,379 | B2 * | 7/2015 | Ciuperca | E04G 17/14 |
| 9,765,540 | B2 * | 9/2017 | Maunder | E04G 23/024 |
| 10,151,069 | B2 | 12/2018 | Yun | |
| 2005/0108985 | A1 * | 5/2005 | Bravinski | E04B 2/8647 52/782.1 |
| 2015/0167332 | A1 * | 6/2015 | Shiota | E04G 23/0218 52/514 |
| 2019/0136389 | A1 | 5/2019 | Kim et al. | |
| 2019/0136551 | A1 * | 5/2019 | Kim | E04C 2/06 |
| 2019/0153728 | A1 * | 5/2019 | Kim | E04C 2/526 |
| 2020/0040580 | A1 * | 2/2020 | Kim | E04C 5/073 |
| 2020/0263416 | A1 * | 8/2020 | Walsh | E04C 2/288 |

FOREIGN PATENT DOCUMENTS

| | | |
|---|---|---|
| KR | 101434523 | 9/2014 |
| KR | 101612800 | 4/2016 |
| KR | 101994852 | 7/2019 |
| KR | 102003670 | 7/2019 |

* cited by examiner

ANCHOR PIN FOR PLACING SHOTCRETE AND FIXING TEXTILE GRID AND METHOD OF CONSTRUCTING TEXTILE GRID REINFORCED SHOTCRETE USING THE SAME

CROSS-REFERENCE TO RELATED APPLICATION

This application claims priority to and the benefit of Korean Patent Application No. 10-2019-0109412, filed on Sep. 4, 2019, the disclosure of which is incorporated herein by reference in its entirety.

BACKGROUND

Field of the Invention

The present invention relates to a method of constructing textile grid reinforced shotcrete and, more specifically, to a method of constructing textile grid reinforced shotcrete using an anchor pin for repairing and reinforcing a concrete structure using a textile grid reinforcement and shotcrete.

Description of Related Art

Generally, a degradation phenomenon, in which quality of concrete is gradually degraded due to weather changes and actions of various kinds of polluted water, such as seawater, groundwater, and rainwater, and compounds, proceeds on various concrete structures constructed for construction and civil engineering. Therefore, safety inspections are regularly performed on these concrete structures, and when a safety inspection result does not meet a required strength of the concrete structure or when damage, such as abnormal peeling, peeling and falling, or cracking, is found, repair and reinforcement operations for increasing a load carrying capacity and stiffness of the concrete structure should be performed.

As a technology related to the repair and reinforcement of such a concrete structure, a method of increasing a load carrying capacity of a concrete structure using a stainless-steel wire mesh assembled in a lattice form is disclosed. However, when the concrete structures are repaired and reinforced using a wire mesh, the quality may be affected by a tensile condition of the wire mesh attached to the concrete structure, and it is not easy to secure a tensile force of the wire mesh, and thus there is a disadvantage in that the repair and reinforcement effects are reduced.

Meanwhile, lattice-shaped geogrids (hereinafter, referred to as "grid") refer to a reinforcement material used for retaining-wall reinforcement, slope reinforcement, ground reinforcement, and the like when civil engineering construction is conducted. The grid requires a high tensile strength and low tensile strain in addition to properties such as constructability, a frictional property, and the like.

A method of manufacturing such a grid generally includes injection-molding or extruding a plastic material, punching the injection-molded and extruded plastic material, and uniaxially and biaxially elongating the plastic material. However, the lattice-shaped grid using the injection-molded plastic has low tensile strength, is difficult to be manufactured in a series of processes, and has limitations in size or shape.

Recently, high strength fiber is woven or knitted into a lattice-shaped textile so that a textile grid fabric is provided, a surface of the fabric is coated with a resin coating solution such as polyvinyl chloride, bitumen, acryl, latex, a rubber-based resin, or the like, and high temperature heating treatment is performed on the surface, and thus a textile grid reinforcement is manufactured to be effectively used to newly construct and reinforce a concrete structure.

Further, since the textile grid reinforcement uses higher strength fiber than a plastic grid reinforcement, the textile grid reinforcement has high tensile strength and low tensile strain so as to have excellent structural material properties for constructing and reinforcing structures.

FIGS. 1*a*, 1*b* and 1*c* are views illustrating a general textile grid reinforcement and a structure reinforced by the general textile grid reinforcement. FIG. 1*a* illustrates a textile grid reinforcement, FIG. 1*b* illustrates a sewage gutter reinforced by the textile grid reinforcement, and FIG. 1*c* illustrates a concrete wall reinforced by the textile grid reinforcement.

As shown in FIG. 1*a*, recently, a textile grid is produced by weaving or knitting high-strength fiber, such as carbon fiber, or aramid fiber, into a lattice-shaped textile, and the textile grid is impregnated with an epoxy, vinyl ester, a styrene butadiene rubber (SBR) resin, or the like so that a textile grid reinforcement 10 is manufactured. The textile grid reinforcement 10 has been effectively used for building, repairing, and reinforcing the concrete structures such as the sewage gutter shown in FIG. 1*b* or the concrete wall shown in FIG. 1*c*.

FIGS. 2*a* and 2*b* are views illustrating a textile grid reinforcement produced through a weaving method.

As shown in FIGS. 2*a* and 2*b*, a textile grid reinforcement 10 includes wefts 10*a* and warps 10*b*, wherein each of the wefts 10*a* and the warps 10*b* is impregnated with a bundle of fiber 11 and a resin 12, but the completed textile grid reinforcement 10 is soft enough to be wound in the form of a roll. There are various methods of manufacturing a textile grid reinforcement, but for mass production, the textile grid reinforcement having a lattice shape may be woven in a method in which a plurality of wefts 10*a* and warps 10*b* cross to be coupled to each other.

As shown in FIG. 2*b*, since the textile grid reinforcement produced through such a weaving method is twist-woven from the warps 10*b*, elongation in a warp direction of the warp 10*b* is greater than a weft direction of the weft 10*a* linearly disposed as a main direction.

Meanwhile, there are primarily two methods for repairing and reinforcing an existing concrete structure for reinforcement and repair due to aging, lack of load carrying capacity, lack of seismic resistance, and the like using a textile grid reinforcement and shotcrete. In this case, the shotcrete refers to concrete or mortar sprayed on a construction surface using compressed air and uses a material having properties to protect a steel material and a stable quality in addition to required strength, durability and watertightness.

First, a textile grid reinforcement is fixedly spaced a predetermined distance from a surface of an existing concrete structure, and shotcrete is placed on an upper part of the textile grid reinforcement. Second, a fixing device that may fix a textile grid reinforcement to a surface of the existing concrete structure is formed in advance, primary shotcrete is placed on the fixing device, a textile grid reinforcement is fixed, and secondary shotcrete is placed on an upper portion of the textile grid reinforcement to finish a cross-section to be repaired.

FIGS. 3*a* and 3*b* are views respectively illustrating an example of a front side and an example of a lateral side, on which a textile grid reinforcement according to the related art is mounted, wherein FIG. 3*a* represents a front view, and FIG. 3*b* represents a lateral view.

As shown in FIGS. 3*a* and 3*b*, in the case of a method of repairing and reinforcing a concrete structure using a textile grid reinforcement and shotcrete described above in the first method, holes are formed in a surface of the concrete structure, a plurality of anchors 20 are installed therein, a textile grid reinforcement 10 is mounted in a fixing device 30, and shotcrete is constructed. The repairing and reinforcing method has an advantage in that the textile grid reinforcement 10 is precisely mounted but has disadvantages in that a speed of anchor construction is low and construction quality of shotcrete on a rear surface of the textile grid reinforcement is low due to rebound when the shotcrete is placed.

Meanwhile, FIGS. 4*a* to 4*c* are views illustrating an example of shotcrete construction according to the related art.

In the case of a method of repairing and reinforcing a concrete structure using a textile grid reinforcement and shotcrete described above in the second method, as shown in FIG. 4*a*, the primary shotcrete is constructed, as shown in FIG. 4*b*, the textile grid reinforcement is mounted and secondary shotcrete is constructed thereon, and as shown in FIG. 4*c*, a surface of the shotcrete is finished. The repairing and reinforcing method has an advantage of fast construction but has disadvantages in that it is difficult to construct primary and secondary shotcrete at precise thicknesses and on a curved surface and an upper surface of the concrete structure.

Meanwhile, a method regarding a method of mounting and fixing a textile grid reinforcement to an existing concrete structure in the above-described construction method will be disclosed below.

First, as a related art, an invention named "Concrete Structure Using a Deformed Steel Wire Mesh and Reinforcement Method Thereof" disclosed in Korean Registered Patent No. 10-1169770 will be described with reference to FIG. 5.

FIG. 5 is a view illustrating a concrete structure reinforced using a deformed steel wire mesh according to the related art.

Referring to FIG. 5, the concrete structure using the deformed steel wire mesh according to the related art includes a deformed steel wire mesh pressed against an inner surface of a conduit that requires repair and reinforcement, a fixing part 50 fixing the deformed steel wire mesh to an inner surface of the conduit, and a covered concrete placed and cured on the deformed steel wire mesh fixed by the fixing part 50.

The deformed steel wire mesh includes deformed steel wire rods 40 provided to cross each other in a lattice form, wherein each of the deformed steel wire rods 40 includes a cylindrical rod 41 and at least one deformed part 42 formed to have a width greater than that of the cylindrical rod 41, and a cross-sectional area of the deformed part 42 is the same as that of the cylindrical rod 41. In this case, an intersecting portion of the deformed steel wire rods 40 may be fixed through welding or fixed through binding using a fixing member.

The fixing part 50 includes a body 51, a buried pin 52, a fastening bolt 53, and a nut 54, wherein the buried pin 52 protrudes downward from a lower portion of the body 51 and has an end portion inclined to be buried in an inner surface of a conduit, the fastening bolt 53 has an accommodation groove 53*b* formed in an upper portion of the body 51 to accommodate the cylindrical rod 41, and the nut 54 is fastened with the fastening bolt 53 to fix the cylindrical rod 41 coupled to the accommodation groove 53*b* of the fastening bolt 53. In this case, a pressing protrusion 53*a* obliquely protrudes from an interior of the accommodation groove 53*b*.

In the case of the concrete structure reinforced by the deformed steel wire mesh according to the related art, the deformed steel wire mesh formed in a lattice form and having at least two repeated shapes is fixed to an inner surface of the damaged conduit by the fixing part, and concrete is placed on the deformed steel wire mesh, and thus adhesion and durability of the covered concrete can be increased. Further, the deformed steel wire mesh is buried in and fixed to the damaged inner surface of the conduit by the fixing part so that processes and time for installing the deformed steel wire mesh are reduced, and thus installation costs can be reduced.

As another related art, an invention named "Method of Repairing and Seismic-Reinforcing a Concrete Structure Using Inorganic-Based Cement Matrix and Coated Fiber Grid" is disclosed in Korean Registered Patent No. 10-1434523 and relates to a method of repairing and seismic-reinforcing a concrete structure to which a fiber grid and an inorganic-based cement matrix is applied, and a rivet-shaped fixing part is suggested. Further, an invention named "Method of Repairing and Reinforcing a Concrete Structure Using High Grid Structure" is disclosed in Korean Registered Patent No. 10-0454021, and a method of fixing a grid to existing concrete using a fixing part with an anchor fastening hole is suggested.

Further, as still another related art, an invention named "Method of Repairing and Reinforcing Tunnel, Bridge, Common Duct, and Reinforced Concrete Structure Using Lattice-Shaped Fiber Mesh and Cement Matrix as Reinforcement for Increasing Load Carrying Capacity and Fire Resistance" is disclosed in Korean Registered Patent No. 10-1612800. The invention relates to a method of repairing, reinforcing, and increasing seismic performance of a structure using a lattice-shaped mesh and a cement matric with increased adhesion and fire resistance as a method of fixing a lattice-shaped fiber mesh to an existing concrete using a rivet-shaped temporary fixing part and will be described in detail with reference to FIG. 6.

FIG. 6 is an operation flowchart for describing a method of repairing and reinforcing a reinforced concrete structure using a lattice-shaped fiber mesh and a cement matric as a reinforcement according to the related art.

Referring to FIG. 6, a method of repairing and reinforcing a reinforced concrete structure using a lattice-shaped fiber mesh and a cement matrix according to the related art is as follows. First, a design of repairing, reinforcing, and seismically reinforcing the reinforced concrete structure to be repaired, reinforced, and seismically reinforced is performed (step S10), the surface is finished for maintaining a wet state while a surface of the reinforced concrete structure is formed in a clean state, and a wet surface is formed (step S20).

Next, a primary cement matrix grouting which primarily applies a cement matrix is performed (step S30), and a lattice-shaped fiber mesh for fixing the lattice-shaped fiber mesh is fixed (step S40).

Next, a second cement matrix grouting which applies a cement matrix to a surface of the reinforcement concrete structure coated with the lattice-shaped fiber mesh to complete construction is performed (step S50), and a surface protecting agent that applies a surface protecting agent for protecting a cement matrix is applied (step S60).

Specifically, the lattice-shaped fiber mesh has a structure in which a longitudinal fiber that extends in a longitudinal direction and a transverse fiber that extends in a transverse direction cross each other to be formed in a lattice shape. In the lattice-shaped fiber mesh, the longitudinal fiber and the transverse fiber are formed of the same material or different materials but, particularly, may be formed by varying the number and the strand number of the longitudinal and transverse fibers.

In the method of repairing and reinforcing a reinforced concrete structure using a lattice-shaped fiber mesh and a cement matrix as a reinforcement according to the related art, repair and reinforcement can be increased due to an increase in adhesive performance and strength expression of the cement matrix. Further, adhesion of the lattice-shaped fiber mesh can be increased using the cement matrix with improved adhesion and fire resistance, and thus reinforcement and seismic reinforcement can be increased, and the fire resistance of the reinforced concrete structure can be increased in the event of fire.

However, in the case of the method of repairing and reinforcing a reinforced concrete structure using a lattice-shaped fiber mesh and a cement matrix as a reinforcement according to the related art, as described above, a fiber mesh is easily degraded so that adhesion may be lost, and cement-based mortar may be easily delaminated. Further, when one surface of the concrete in which damage or degradation occurs is repaired with a cement-based material or through an adhesive method, the aesthetics of the repaired concrete structure may be degraded.

Finally, the problems of the method of repairing and reinforcing a reinforced concrete structure using a lattice-shaped fiber mesh and a cement matrix as a reinforcement according to the related art are as follows.

First, in a method of fixing a textile grid reinforcement to an existing concrete structure, since a set anchor or the like that requires drilling is used, a hole is first formed in a surface of the existing concrete structure, and the anchor is fixedly inserted thereinto. In this case, given that the textile grid reinforcement is ductile, since the textile grid reinforcements should be fixed at intervals in a range of about 20 to 30 cm, constructability is low, and particularly, anchors should be very densely installed for precise construction of a wall, a lower surface of a slab, a curved surface, and the like. However, since the construction method according to the related art has low constructability, the anchor cannot be installed sufficiently, and thus there is a problem in that the construction quality is low.

Second, when a textile grid reinforcement is constructed, a textile grid reinforcement should be constructed in the middle of a thickness direction of shotcrete when viewed from the final complete cross-sectional surface, and thus a cross-section of primary shotcrete should be formed on a surface of the existing concrete structure at an accurate thickness, and the textile grid reinforcement should be mounted and fixed. However, due to characteristics of the shotcrete, which requires continuous casting, the primary placing thickness cannot be visually checked during construction and is difficult to measure during construction, and thus there is a limit to shotcrete being placed at an accurate thickness.

Third, even when secondary shotcrete is placed after the textile grid reinforcement is fixed, since it is difficult to accurately check a final placing thickness, it is difficult to construct shotcrete having an accurate thickness.

(Patent Document 0001) Korean Registered Patent No. 10-1612800 (Registered on Apr. 8, 2016), Title of Invention: "Method of Repairing and Reinforcing Tunnel, Bridge, Common Duct, and Reinforced Concrete Structure Using Lattice-Shaped Fiber Mesh and Cement Matrix as Reinforcement for Increasing Load Carrying Capacity and Fire Resistance"

(Patent Document 0002) Korean Registered Patent No. 10-1434523 (Registered on Aug. 20, 2014), Title of Invention: "Method of Repairing and Seismic-Reinforcing Concrete Structure Using Inorganic-Based Cement Matrix and Coated Fiber Grid" (Patent Document 0003) Korean Registered Patent No. 10-1169770 (Registered on Jul. 24, 2012), Title of Invention: "Concrete Structure Using Deformed Steel Wire Mesh and Method of Reinforcing the Same"

(Patent Document 0004) Korean Registered Patent No. 10-0454021 (Registered on Oct. 13, 2004), Title of Invention: "Method of Repairing and Reinforcing Concrete Structure Using High-Grid Structure"

(Patent Document 0005) Korean Registered Patent No. 10-1994852 (Registered on Jun. 25, 2019), Title of Invention: "Concrete Structure Using Reinforcing Panel with Buried Lattice-Shaped Reinforcement and Method of Reinforcing and Repairing the Same"

(Patent Document 0006) Korean Registered Patent No. 10-2003670 (Registered on Jul. 19, 2019), Title of Invention: "Textile Grid Reinforced Concrete Structure Using Textile Grid Fixing Device and Construction Method Thereof"

SUMMARY

According to an aspect of the present invention, there is provided an anchor pin for placing shotcrete and fixing a textile grid which includes a driving part serving as a front end part and driven in a concrete structure to be repaired and reinforced at a predetermined driving thickness, a middle body part that extends from an upper portion of the driving part in a cylindrical form so that a placing thickness of primary shotcrete is checked, an upper body part that extends from an upper portion of the middle body part in a cylindrical form so that a placing thickness of secondary shotcrete is checked, a driving depth limiting lateral node formed between the driving part and the middle body part to protrude in a ring shape and formed in a lateral direction to limit a driving depth of the driving part, and a grid fixing part including an upper separation node and a lower separation node that are formed between the middle body part and the upper body part to protrude in a ring shape, wherein a groove is formed between the upper separation node and the lower separation node in a lateral direction so that a textile grid reinforcement is insertion-mounted therein.

The anchor pin may be loaded in an air tacker and driven in the concrete structure.

The driving part, the middle body part, the upper body part, the driving depth limiting lateral node, and the grid fixing part may be formed of a non-corrosive steel material with strength sufficient to be driven in concrete.

The driving part, the middle body part, the upper body part, the driving depth limiting lateral node, and the grid fixing part are integrally formed in the form of a nail.

The driving depth limiting lateral node and the grid fixing part may be formed in the form of a sleeve and fastened to the driving part, the middle body part, and the upper body part.

The middle body part may be formed between the driving depth limiting lateral node and the lower separation node of the grid fixing part and may serve as a reference part with which the placing thickness of the primary shotcrete is visually checked.

The upper body part may be formed from the upper separation node of the grid fixing part to an uppermost end of the anchor pin and may serve as a reference part with which the placing thickness of the secondary shotcrete is visually checked.

The concrete structure to be repaired and reinforced may refer to a lower portion of a slab, a wall, or a lining of a tunnel with a curved surface.

According to an aspect of the present invention, there is provided a method of constructing textile grid reinforced shotcrete using an anchor pin which includes a) driving and fixing an anchor pin in and to a surface of a concrete to be repaired and reinforced at a predetermined driving thickness, b) placing primary shotcrete up to a lower separation node of a grid fixing part of the anchor pin at a placing thickness of primary shotcrete, c) insertion-mounting a textile grid reinforcement in a groove formed between nodes of a grid fixing part of the anchor pin, d) placing secondary shotcrete up to an uppermost end of the anchor pin at a placing thickness of the secondary shotcrete, and e) finishing an exposed surface and completing repair and reinforcement of the concrete structure, wherein the anchor pin includes a driving part serving as a front end part and driven in the concrete structure to be repaired and reinforced at the predetermined driving thickness, a middle body part that extends from an upper portion of the driving part in a cylindrical form so that the placing thickness of the primary shotcrete is checked, an upper body part that extends from an upper portion of the middle body part in a cylindrical form so that the placing thickness of the secondary shotcrete is checked, a driving depth limiting lateral node formed between the driving part and the middle body part to protrude in a ring shape and formed in a lateral direction to limit a driving depth of the driving part, and a grid fixing part including an upper separation node and a lower separation node that are formed between the middle body part and the upper body part to protrude in a ring shape, wherein a groove is formed between the upper separation node and the lower separation node in a lateral direction so that a textile grid reinforcement is insertion-mounted therein.

In operation a), the anchor pin may be driven and fixed using an air tacker, and before operation a), the anchor pin corresponding to a thickness of entire shotcrete may be selected and loaded in the air tacker.

The driving number of anchor pins identical to the anchor pin may be set based on a state and curvature of the concrete structure, a type of the textile grid reinforcement, and a thickness of shotcrete, and the anchor pins may be driven at intervals of 20 cm.

An entire length of the anchor pin and each of the driving thickness and the placing thicknesses may be determined based on an entire construction thickness of the shotcrete.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1A:
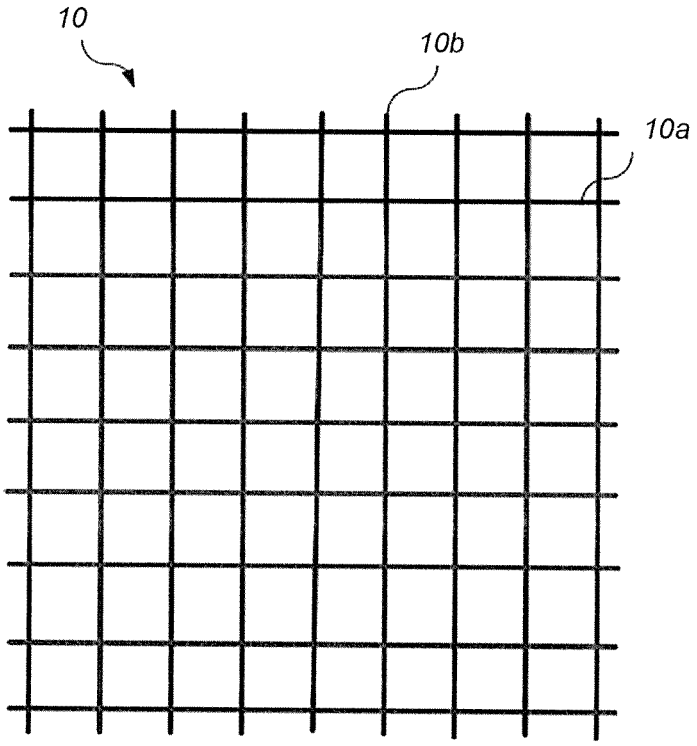
FIGS. 1*a*, 1*b* and 1*c* show views illustrating a general textile grid reinforcement and a structure reinforced thereby.
Figure 1B:
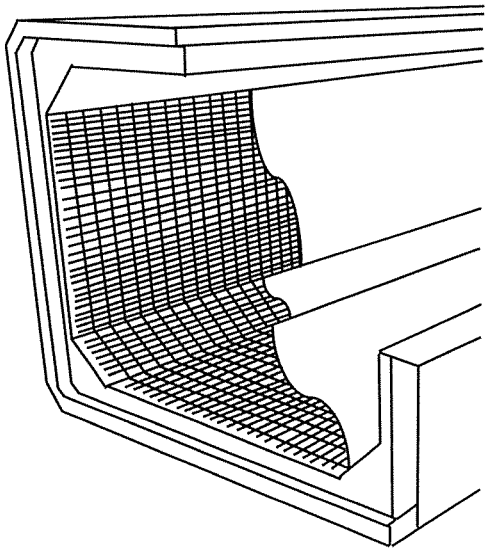
Figure 1C:
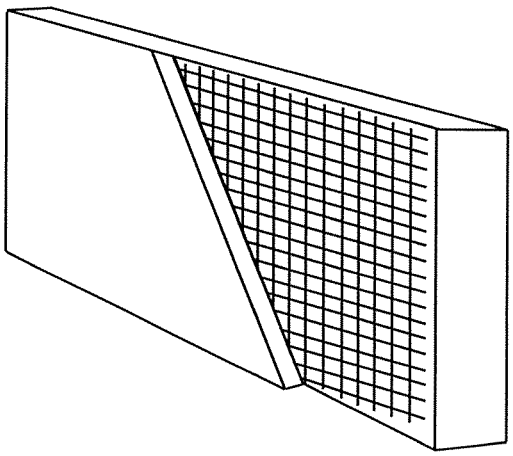
Figure 2A:
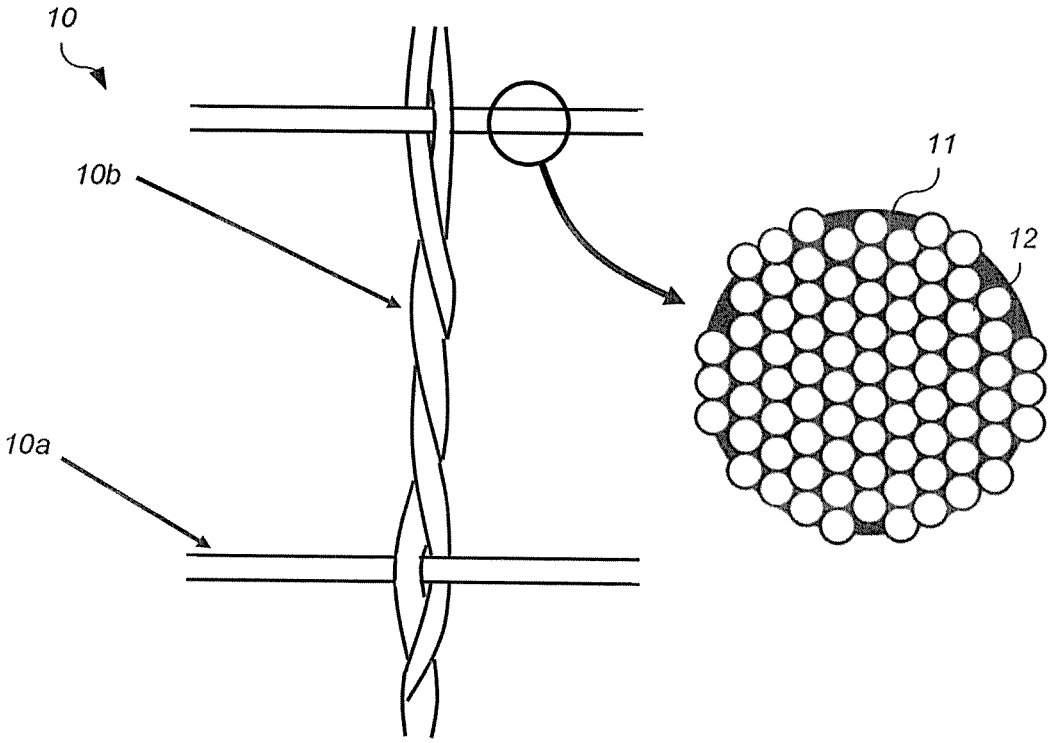
FIGS. 2*a* and 2*b* show views illustrating a textile grid reinforcement produced through a weaving method.
Figure 2B:
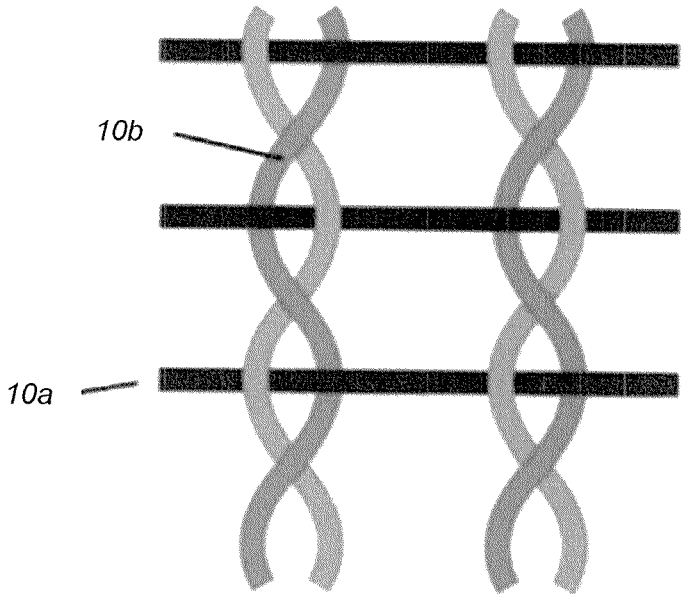
Figure 3A:
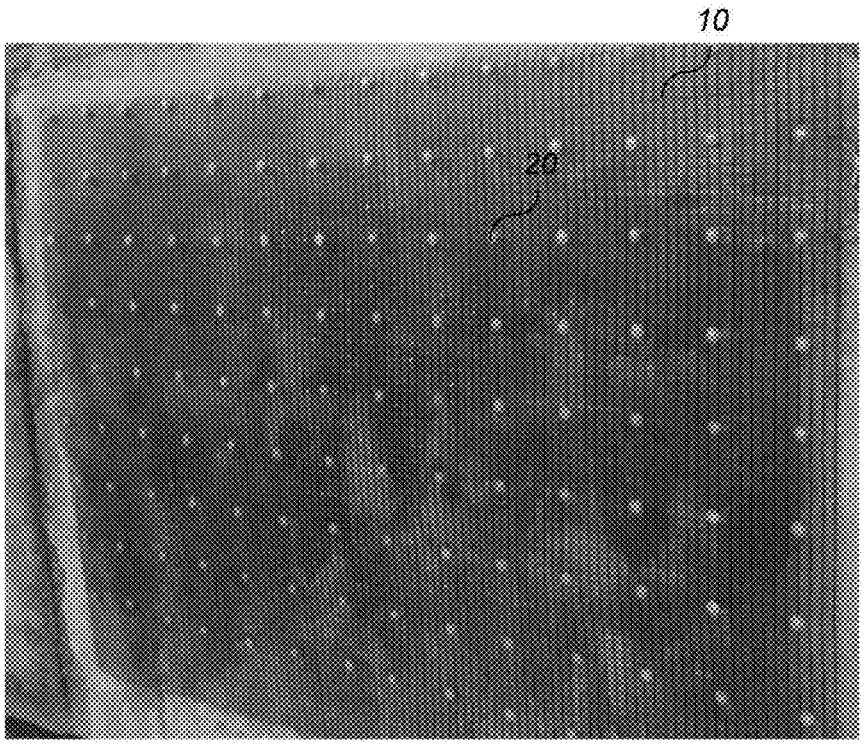
FIGS. 3*a* and 3*b* are views illustrating a front side and a lateral side on which a textile grid reinforcement according to a related art is mounted.
Figure 3B:
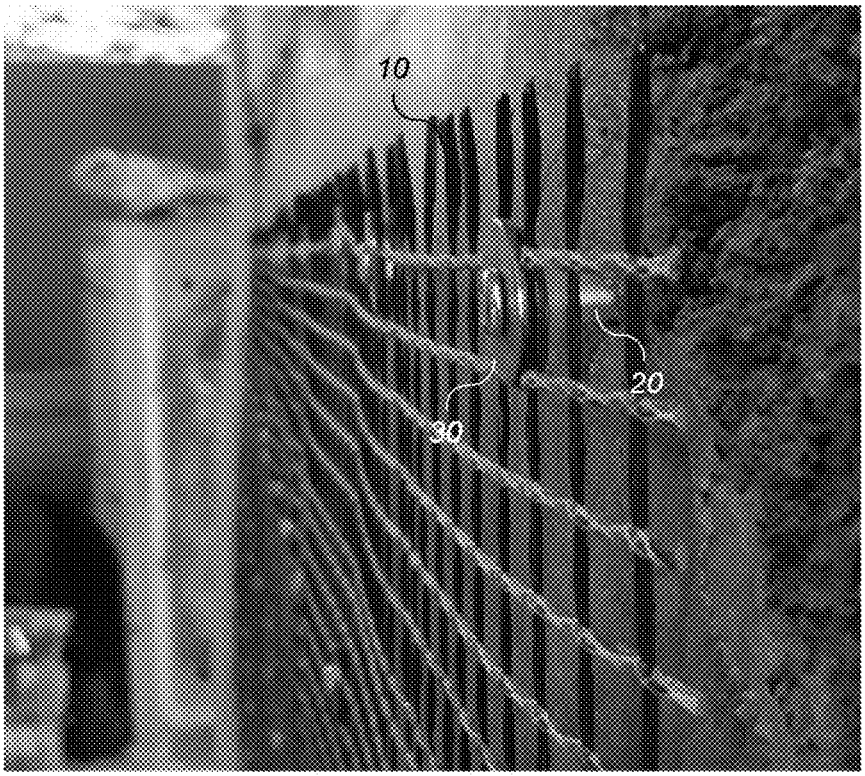
Figure 4A:
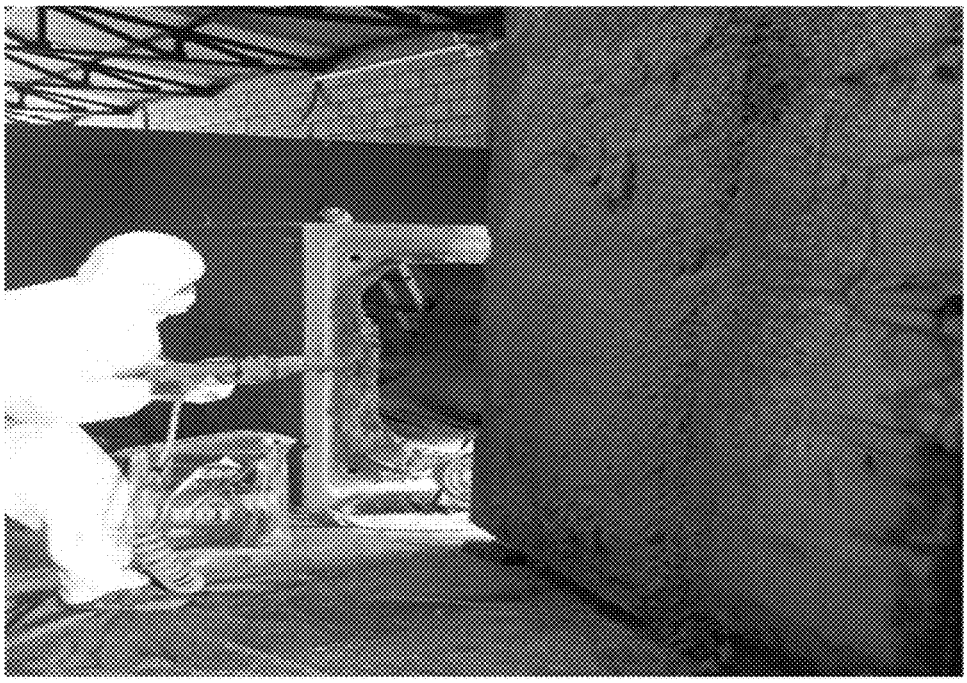
FIGS. 4*a* to 4*c* are views illustrating construction of shotcrete according to the related art.
Figure 4B:
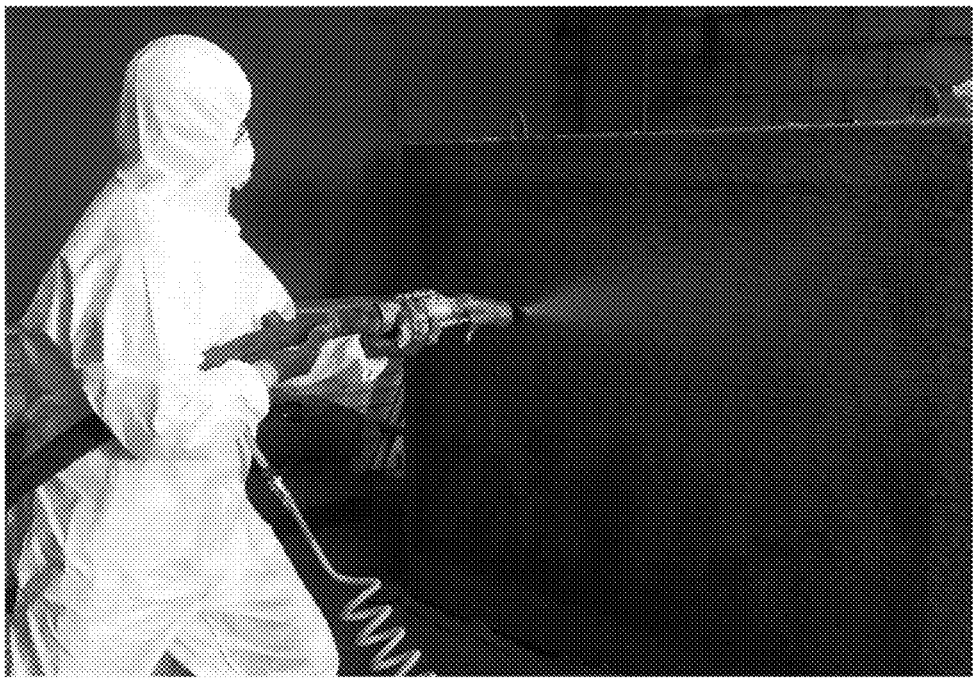
Figure 4C:
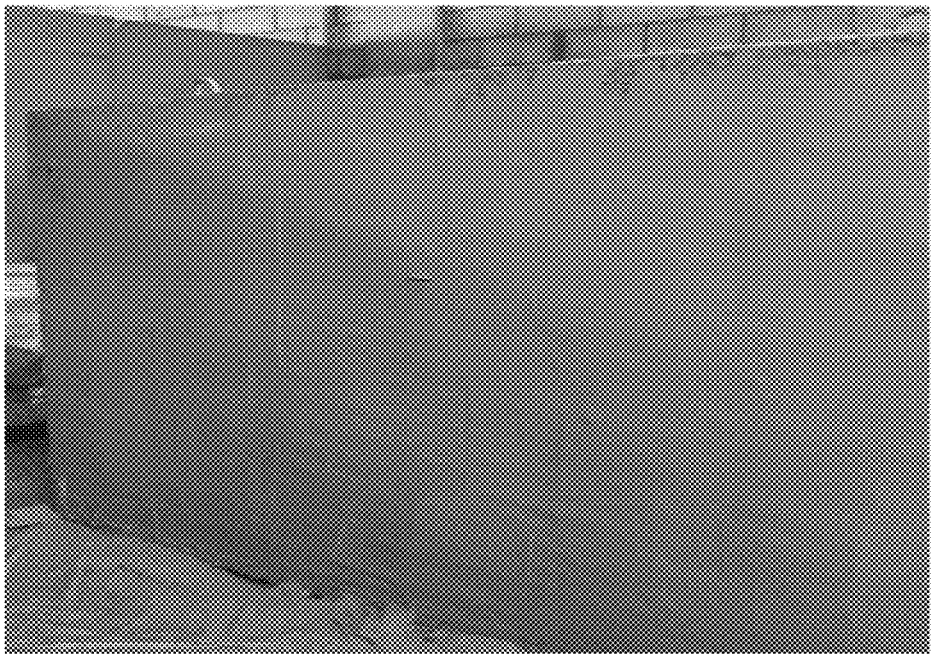
Figure 5:
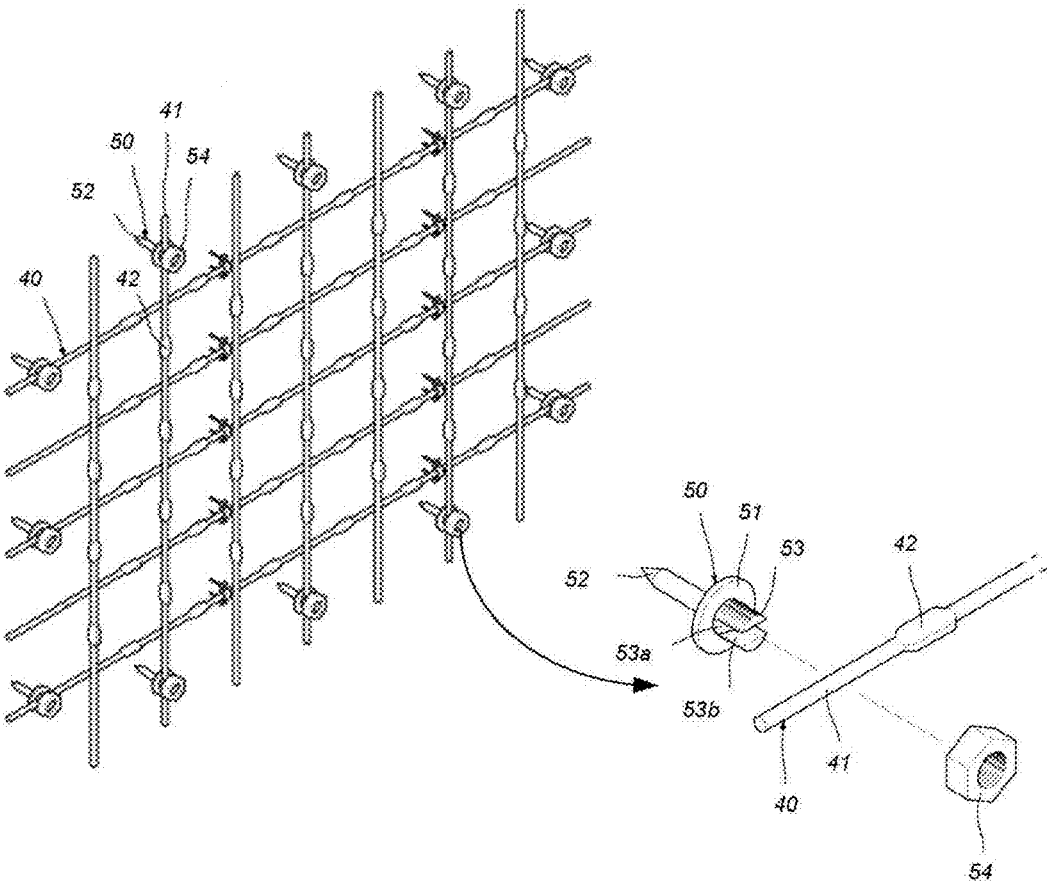
FIG. 5 is a view illustrating a concrete structure reinforced by a deformed steel wire mesh according to the related art.
Figure 6:
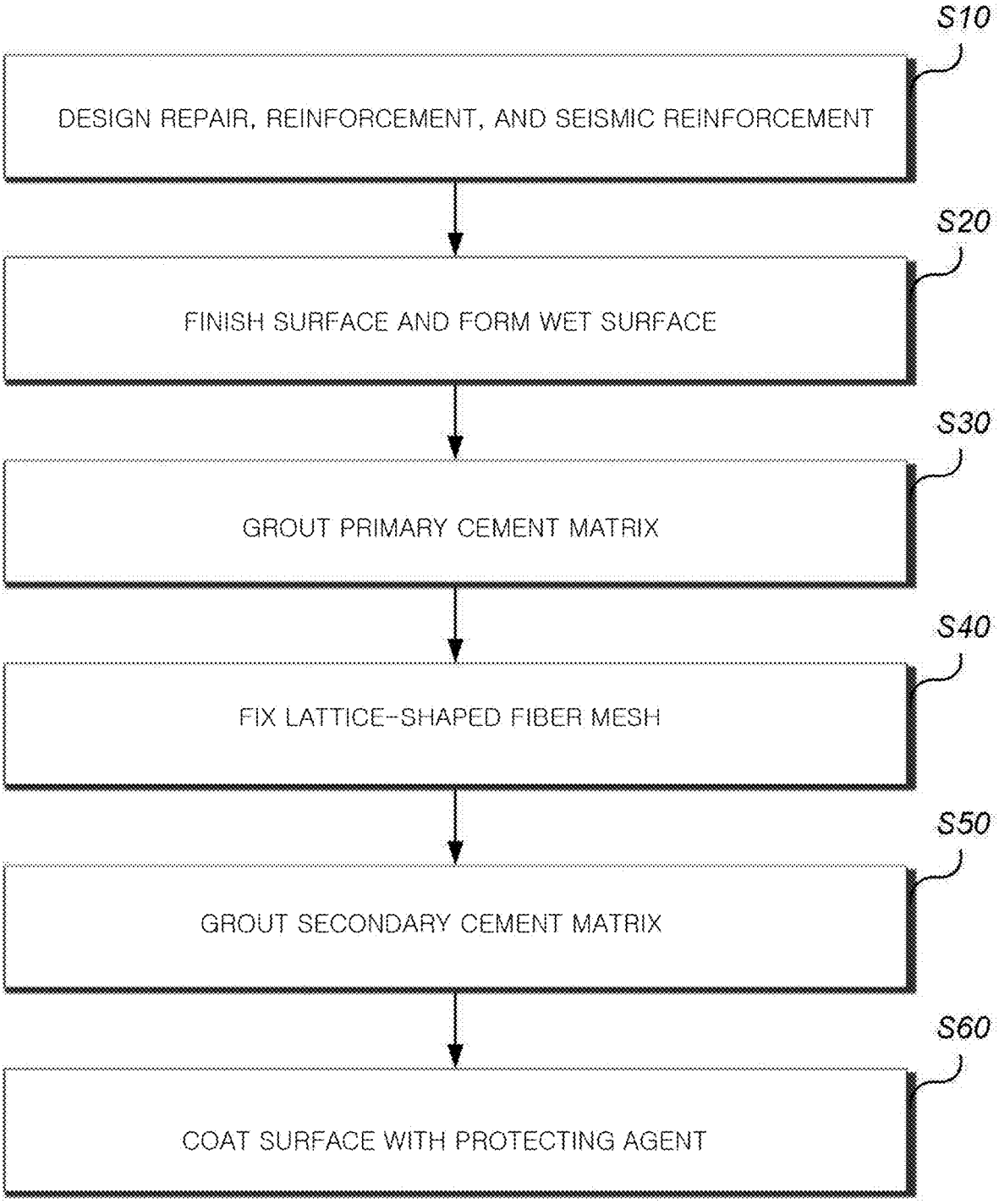
FIG. 6 is an operation flowchart for describing a method of repairing and reinforcing a structure using a lattice-shaped fiber mesh and a cement matrix as a reinforcement according to the related art.

Hereinafter, embodiments that are easily performed by those skilled in the art will be described in detail with reference to the accompanying drawings. However, the embodiments of the present invention may be implemented in several different forms and are not limited to embodiments described herein. In addition, parts irrelevant to description will be omitted in the drawings to clearly explain the embodiments of the present invention. Similar parts are denoted by similar reference numerals throughout this specification.

Throughout the specification, when a portion "includes" an element, the portion may include the element or another element may be further included therein unless otherwise described.

[Anchor Pin 100 for Placing Shotcrete and Fixing Textile Grid]

Figure 7A:
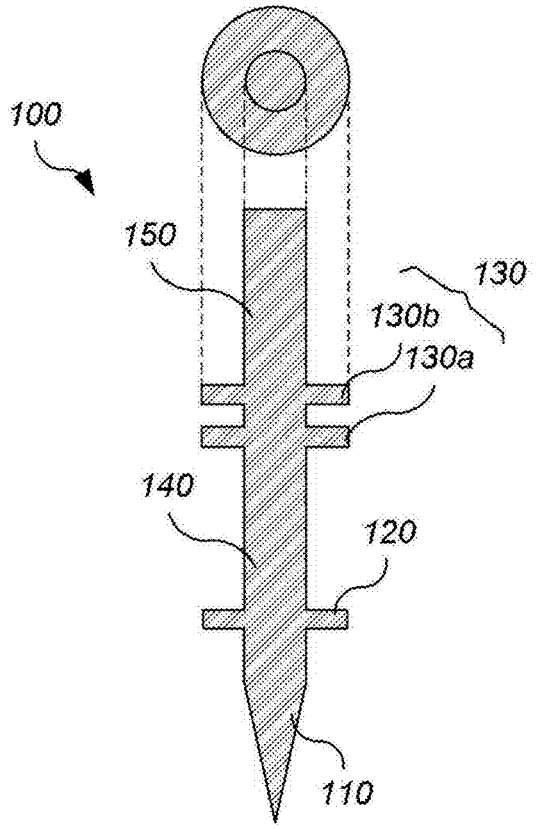
FIGS. 7*a* and 7*b* show cross-sectional views illustrating an anchor pin for placing shotcrete and fixing a textile grid according to one embodiment of the present invention.
Figure 7B:
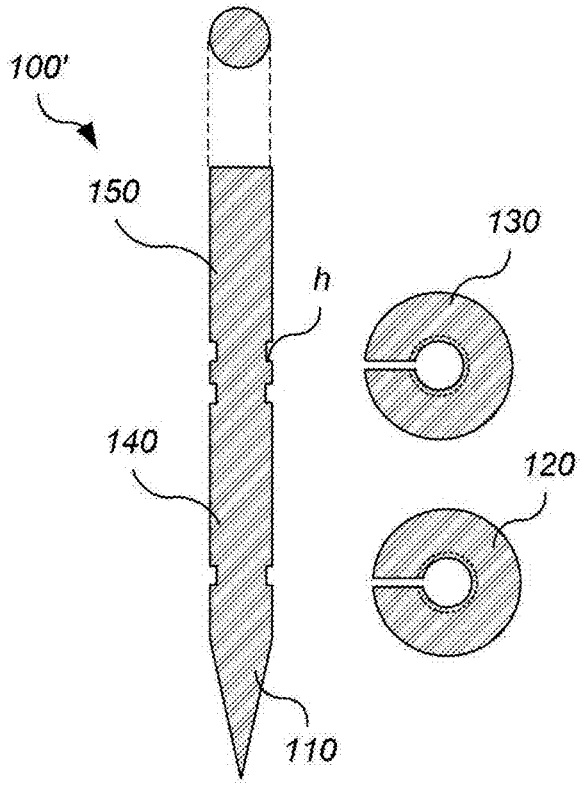
Figure 8:
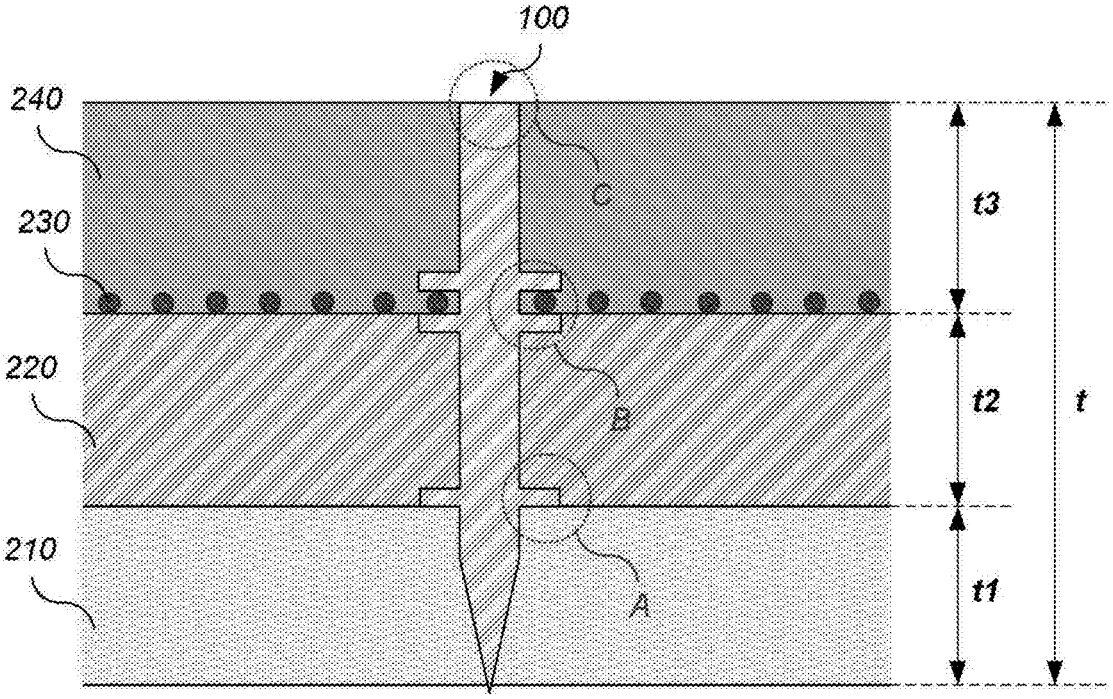
FIG. 8 is a cross-sectional view illustrating shotcrete and a textile grid constructed using the anchor pin according to one embodiment of the present invention.

FIGS. 7*a* and 7*b* show cross-sectional views illustrating an anchor pin for placing shotcrete and fixing a textile grid according to one embodiment of the present invention, wherein FIG. 7*a* shows a view illustrating an integrated anchor pin 100, FIG. 7*b* shows a view illustrating a separable anchor pin 100', and FIG. 8 is a cross-sectional view illustrating shotcrete and a textile grid constructed using the anchor pin according to one embodiment of the present invention.

Referring to FIGS. 7*a*, 7*b* and 8, the anchor pin 100 for placing shotcrete and fixing a textile grid according to one embodiment of the present invention includes a driving part 110, a driving depth limiting lateral node 120, a grid fixing part 130, a middle body part 140, and an upper body part 150.

Figure 11A:
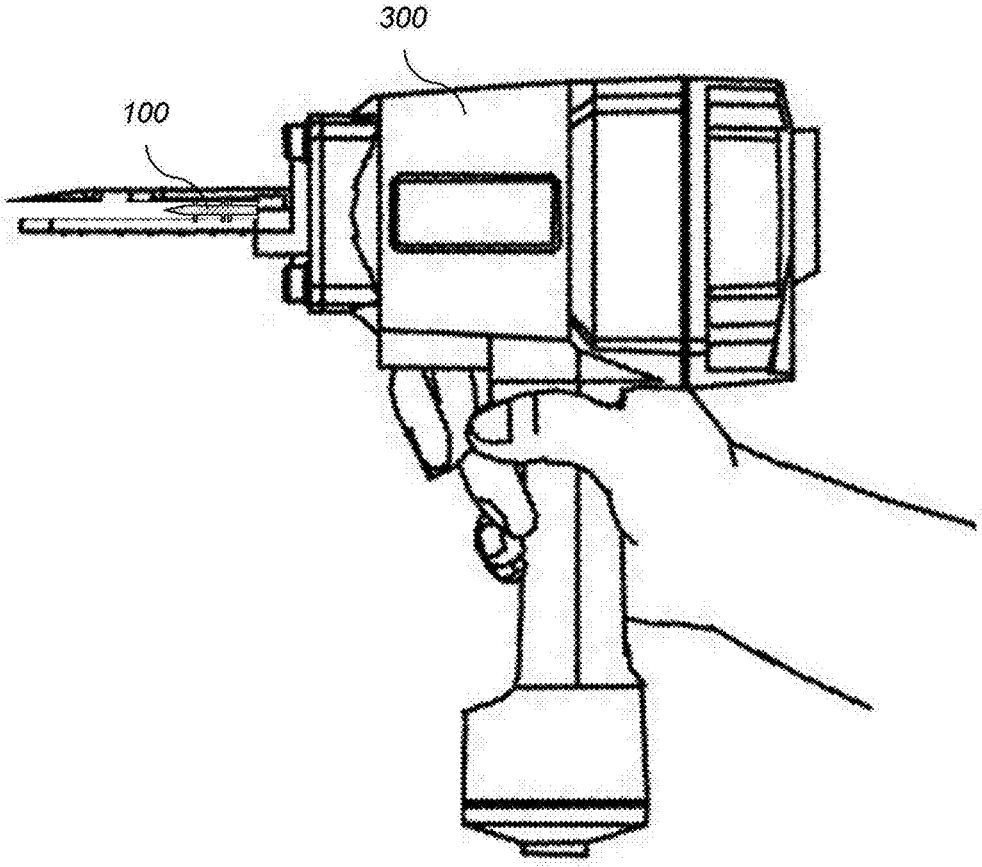
FIGS. 11*a* to 11*e* are views for specifically describing the method of constructing textile grid reinforced shotcrete using an anchor pin according to one embodiment of the present invention.
Figure 11B:
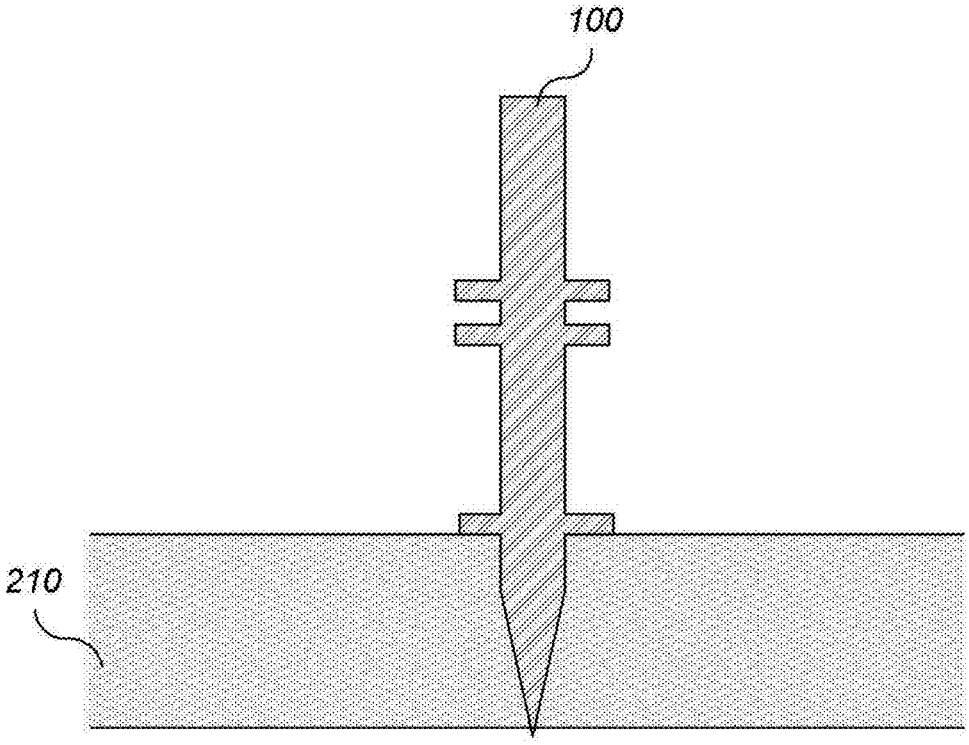

As shown in FIGS. 11*a* and 11*b* described below, as a front end part, the driving part 110 is driven in a concrete structure 210 to be repaired and reinforced to a predetermined driving thickness t1 using an air tacker 300. In this case, the concrete structure 210 to be repaired and reinforced may refer to a lower portion of a slab, a wall, or a lining of a tunnel with a curved surface, but the present invention is not limited thereto. Further, the air tacker is a tool that drives nails, staples, or the like using air pressure at a high speed to attach wood and wood, wood and plastic, wood and steel, wood and concrete, and the like. The air tacker may be very usefully utilized for interior work, aluminum sash work, or the like.

The middle body part 140 extends from an upper portion of the driving part 110 in a cylindrical shape to check a placing thickness t2 of the primary shotcrete 220. In this case, a middle body part 140 is formed between the driving depth limiting lateral node 120 and a lower separation node 130*a* of the grid fixing part 130 and allows the placing thickness t2 of the primary shotcrete 220 to be visually checked.

The upper body part 150 extends from an upper portion of the middle body part 140 in a cylindrical shape so that a placing thickness t3 of the secondary shotcrete 240 is checked. In this case, as shown by a symbol C in FIG. 8, the upper body part 150 is formed from the upper separation node 130*b* of the grid fixing part 130 to an uppermost end of the anchor pin and allows the placing thickness t3 of the secondary shotcrete 240 to be visually checked.

As shown by a symbol A of FIG. 8, the driving depth limiting lateral node 120 protrudes in a ring shape between the driving part 110 and the middle body part 140 and is formed in a lateral direction to limit a driving depth of the driving part 110.

As shown in FIG. 7*a*, the grid fixing part 130 is formed in the central portion of the anchor pin 100, includes an upper separation node 130*b* and a lower separation node 130*a* that are formed between the middle body part 140 and the upper body part 150 to protrude in a ring shape, and has a groove formed between the upper separation node 130*b* and the lower separation node 130*a* in a lateral direction so that the textile grid reinforcement 230 is insertion-mounted therein.

That is, as shown as symbol B in FIG. 8, the grid fixing part 130 allows the textile grid reinforcement 230 to be inserted and fixed so that the primary shotcrete 220 is precisely placed to a primary shotcrete-placing thickness t2. Therefore, after the primary shotcrete 220 is placed, the secondary shotcrete 240 may be precisely placed to have the secondary shotcrete-placing thickness t3 which is as long as a length of the anchor pin 100 remaining for the secondary shotcrete 240 to be placed.

The anchor pin 100 for placing shotcrete and fixing a textile grid according to one embodiment of the present invention may be loaded in the air tacker 300 and driven in the concrete structure 210.

Further, the driving part 110, the middle body part 140, the upper body part 150, the driving depth limiting lateral node 120, and the grid fixing part 130 are formed of a non-corrosive steel material having a strength strong enough to be driven in the concrete, and as shown in FIG. 7*a*, the anchor pin 100 for placing shotcrete and fixing a textile grid according to one embodiment of the present invention may be an integrated anchor pin 100 and, for example, may be integrally formed in the form of a nail.

Further, as shown in FIG. 7*b*, the anchor pin 100 for placing shotcrete and fixing a textile grid according to one embodiment of the present invention may be a separable anchor pin 100', and for example, the driving depth limiting lateral node 120 and the grid fixing part 130 may be formed in the form of a sleeve to be fastened to the driving part 110, the middle body part 140, and the upper body part 150.

Figure 9A:
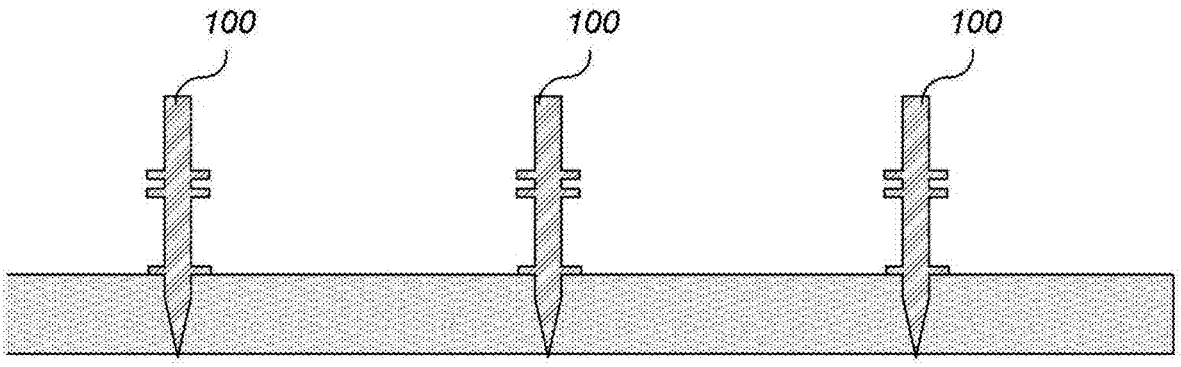
FIGS. 9*a* and 9*b* show views illustrating the anchor pin, which is driven in a concrete structure, for placing shotcrete and fixing a textile grid according to one embodiment of the present invention.
Figure 9B:
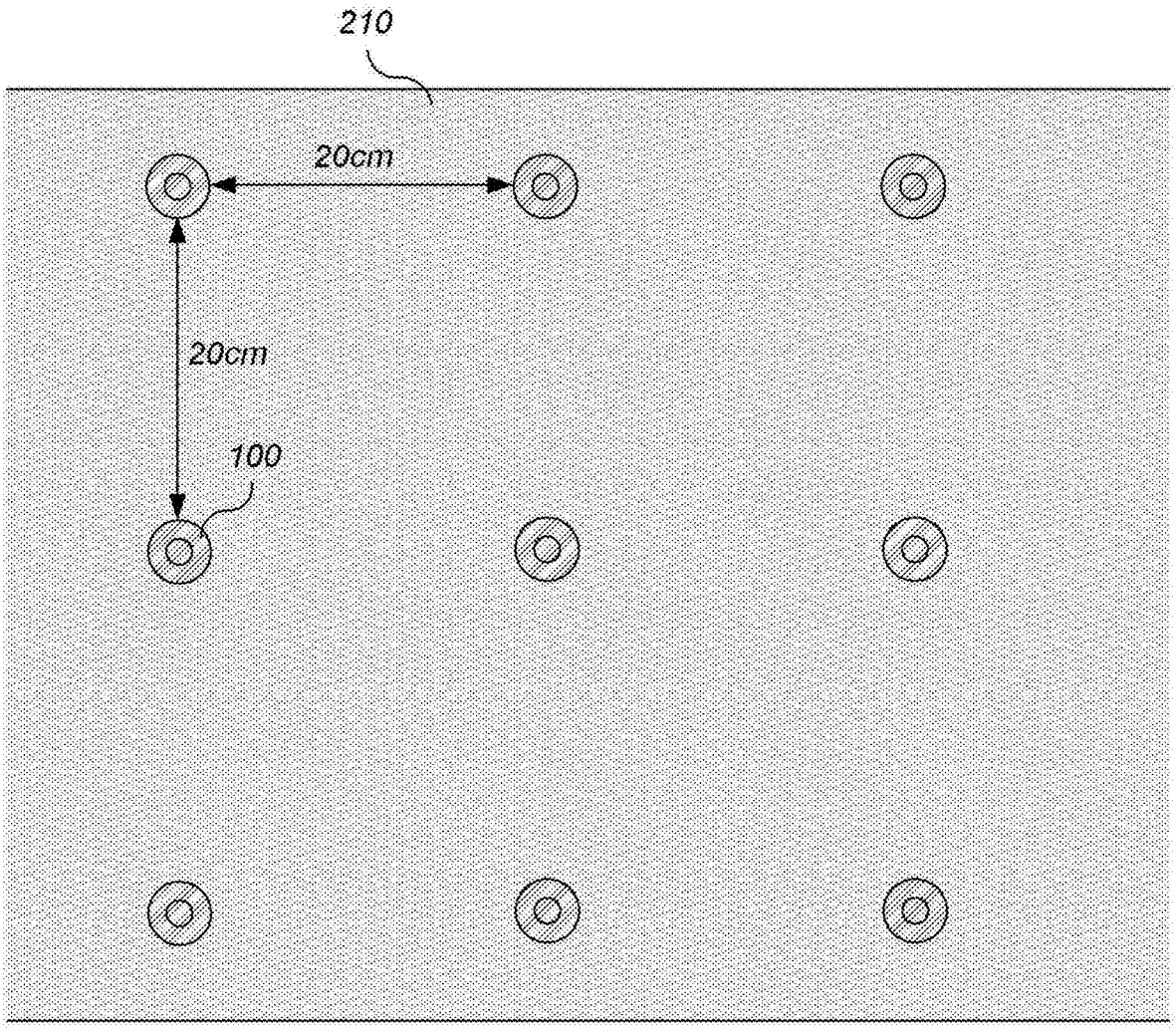

Meanwhile, FIGS. 9*a* and 9*b* show views illustrating an anchor pin, which is driven in a concrete structure, for placing shotcrete and fixing a textile grid according to one embodiment of the present invention, wherein FIG. 9*a* is a cross-sectional view, and FIG. 9*b* is a front view.

As shown in FIGS. 9*a* and 9*b*, the driving number of anchor pins 100 identical to the anchor pin 100 for placing shotcrete and fixing a textile grid according to one embodiment of the present invention is set based on a state and a curvature of the concrete structure 210 to be repaired and reinforced, a type and ductility of the textile grid reinforcement 230, and a thickness of the shotcrete, and as shown in FIG. 9*b*, the anchor pins 100 may be driven at intervals of about 20 cm, but the present invention is limited thereto.

Finally, in the case of the anchor pin 100 for placing shotcrete and fixing a textile grid according to one embodiment of the present invention, the anchor pin 100 is loaded in the air tacker 300 so that constructability can be secured continuously and quickly. Further, the anchor pin 100 of the present invention may be formed of a non-corrosive steel material having strength sufficient to be driven in concrete, the shape of the anchor pin 100 may be formed in the form of a nail and constructed through hitting, drilling, and the like. However, to increase a speed of constructability, as shown in FIG. 11*a* described below, the anchor pins 100 can be quickly fixed to an existing concrete structure using the air tacker 300.

Further, when the shotcrete is constructed, the placing thicknesses t2 and t3 of the primary and secondary shotcrete 220 and 240 can be visually checked using the lower separation node 130*a* and the upper separation node 130*b* of the grid fixing part 130 formed in each of the anchor pins, and the shotcrete can be precisely constructed. [Method of Constructing Textile Grid Reinforced Shotcrete Using an Anchor Pin 100]

Figure 10:
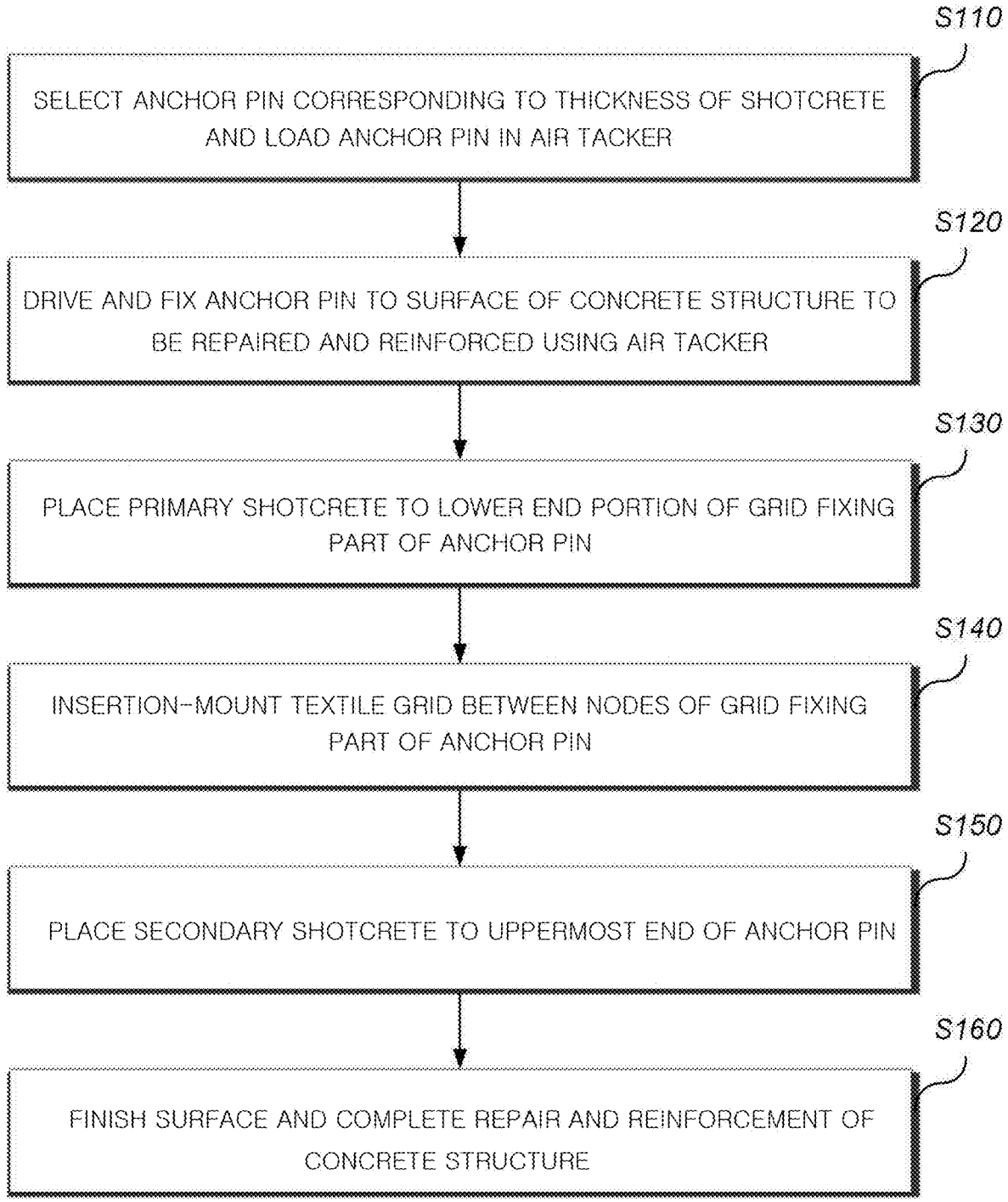
FIG. 10 is an operation flowchart of a method of constructing textile grid reinforced shotcrete using an anchor pin according to one embodiment of the present invention.

FIG. 10 is an operation flowchart of a method of constructing textile grid reinforced shotcrete using an anchor pin according to one embodiment of the present invention, and FIGS. 11*a* to 11*e* are views for specifically describing the method of constructing textile grid reinforced shotcrete using an anchor pin according to one embodiment of the present invention.

Referring to FIGS. 10 and 11*a* to 11*e*, the method of constructing textile grid reinforced shotcrete using an anchor pin according to one embodiment of the present invention is as follows. First, as shown in FIG. 11*a*, the anchor pin 100 corresponding to a thickness of the entire shotcrete is selected and loaded in an air tacker 300 (step S100). In this case, the anchor pin 100 includes a driving part 110, a middle body part 140, an upper body part 150, a driving depth limiting lateral node 120, and a grid fixing part 130, wherein the driving part 110 that serves as a front end part is driven in a concrete structure 210 to be repaired and reinforced to a predetermined driving thickness t1, the middle body part 140 extends from an upper portion of the driving part 110 in a cylindrical shape so that a placing thickness t2 of primary shotcrete 220 is checked, the upper body part 150 extends from an upper portion of the middle body part 140 in a cylindrical shape so that a placing thickness t3 of secondary shotcrete 240 is checked, the driving depth limiting lateral node 120 is formed between the driving part 110 and the middle body part 140 to protrude in a ring shaped and formed in a lateral direction to limit a driving depth of the driving part 110, and the grid fixing part 130 includes an upper separation node 130*b* and a lower separation node 130*a*, which is formed between the middle body part 140 and the upper body part 150 to protrude in a ring shape and has a groove formed between the upper separation node 130*b* and the lower separation node 130*a* in a lateral direction so that the textile grid reinforcement 230 is insertion-mounted therein.

Next, the anchor pin 100 is driven in and fixed to a surface of the concrete structure 210 to be repaired and reinforced to a predetermined driving thickness t2 using an air tacker 300 (step S120). That is, as shown in FIG. 11*b*, the anchor pin 100 is driven in and constructed on a surface of the concrete structure 210 to be repaired and reinforced using the air tacker 300. In this case, regardless of driving force of the air tacker 300, the driving depth limiting lateral node 120 is formed on the upper portion of the driving part 110 in a circular form to accurately adjust the driving depth t1 of the driving part 110 of the anchor pin 100. In this case, the driving number of anchor pins 100 identical to the anchor pins 100 is set based on a state and a curvature of the concrete structure 210 to be repaired and reinforced, a type and ductility of the textile grid reinforcement 230, and a thickness of shotcrete, and the anchor pins 100 may be driven at intervals of about 20 cm.

Figure 11C:
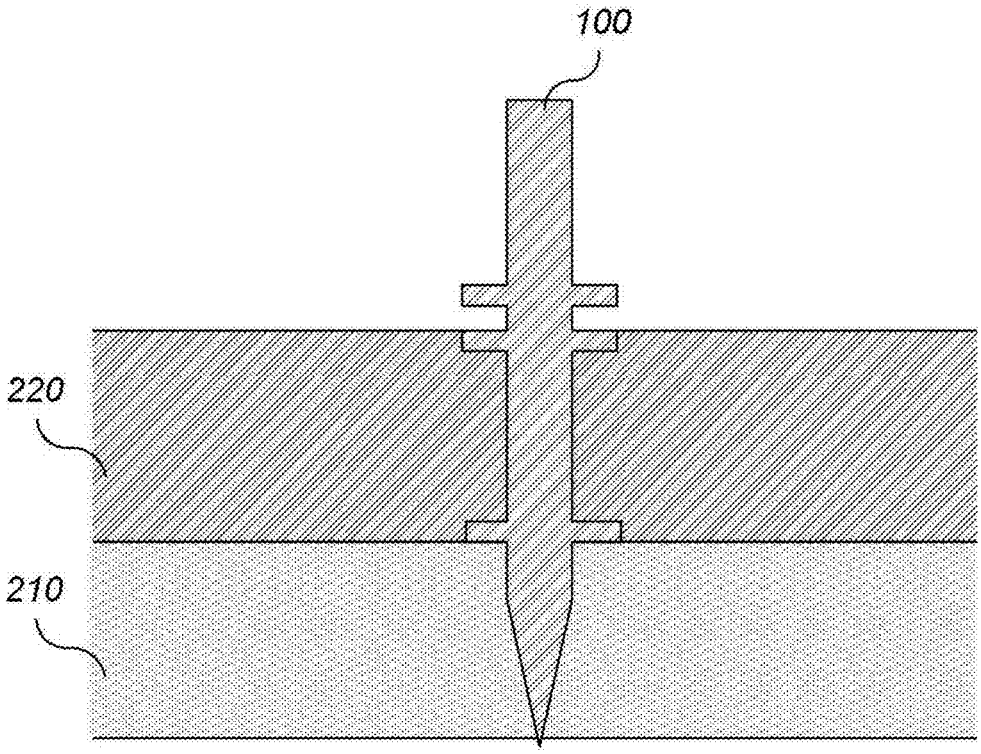

Next, the primary shotcrete 220 is placed to a lower separation node 130*a* of the grid fixing part 130 of the anchor pin 100 at the placing thickness t2 of the primary shotcrete 220 (step S130). That is, as shown in FIG. 11*c*, when the primary shotcrete 220 is placed, the placing thickness t2 of the primary shotcrete is checked by the grid fixing part 130 formed in the middle part of the anchor pin 100 during construction, and thus precise construction should be conducted. Further, since the textile grid reinforcement 230 is fixed to support a construction pressure of the shotcrete, the grid fixing part 130 may be manufactured in a size roughly similar to that of a washer.

Figure 11D:
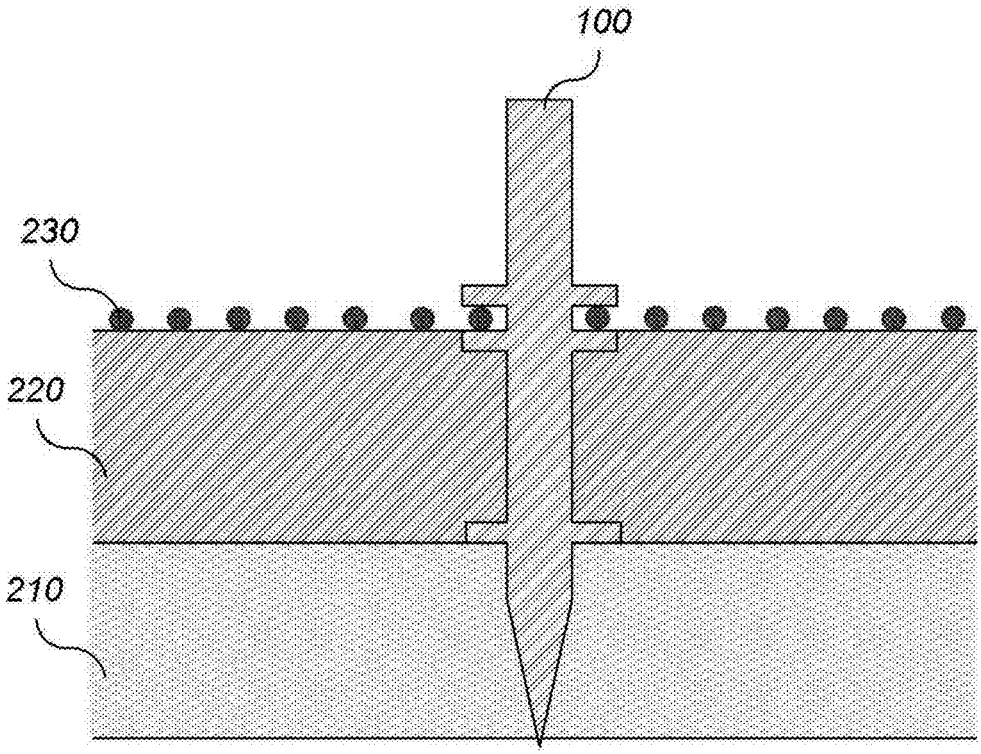

Next, the textile grid reinforcement 230 is insertion-mounted in the groove between the nodes of the grid fixing part 130 of the anchor pin 100 (step S140). That is, as shown in FIG. 11*d*, the textile grid reinforcement 230 is fixedly inserted into the grid fixing part 130. In this case, when the textile grid reinforcement 230 is fixed, one portion of the textile grid reinforcement 230 is slightly pulled to be fixed to the grid fixing part 130, and thus flatness can be maintained.

Figure 11E:
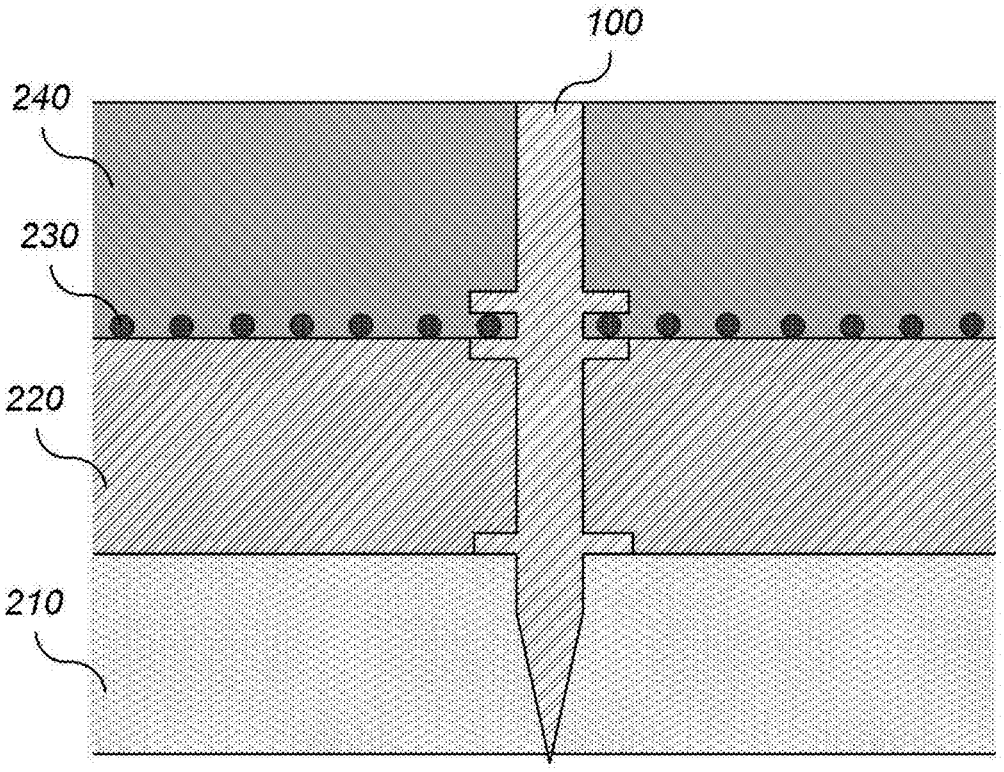

Next, the secondary shotcrete 240 is placed to an uppermost end of the anchor pin 100 at the placing thickness t3 of the secondary shotcrete 240 (step S150). That is, as shown in FIG. 11*e*, when the secondary shotcrete 240 is placed, the placing thickness t3 of the secondary shotcrete matches with the uppermost end of the anchor pin 100 during construction, and thus precise construction can be conducted.

Next, a surface of the secondary shotcrete 240 is finished, and the repair and reinforcement of the concrete structure 210 is completed (step S150).

In the method of constructing a textile grid reinforcement shotcrete using an anchor pin according to one embodiment of the present invention, an entire length t and each of the driving thickness t1 and the placing thicknesses t2 and t3 of the anchor pin 100 are determined based on an entire construction thickness of the primary and secondary shotcrete 220 and 240 designed according to repair and reinforcement purposes and the state of the concrete structure 210. In this case, the anchor pin 100 is formed of a non-corrosive steel material having strength sufficient to be driven in concrete and may be integrally manufactured in the form of a nail.

Further, the driving depth limiting lateral node 120 and the grid fixing part 130 of the anchor pin 100 are formed in the form of a sleeve and fastened between the driving part 110 and the middle body part 140 of the anchor pin 100 and between the middle body part 140 and the upper body part 150 thereof, respectively. Further, the middle body part 140 of the anchor pin 100 is formed between the driving depth limiting lateral node 120 and the lower separation node 130*a* of the grid fixing part 130 so that placing thickness t2 of the primary shotcrete 220 can be visually checked, and the upper body part 150 of the anchor pin 100 is formed from the upper separation node 130*b* of the grid fixing part 130 to the uppermost end of the anchor pin so that the placing thickness t3 of the secondary shotcrete 240 can be visually checked.

Figure 12:
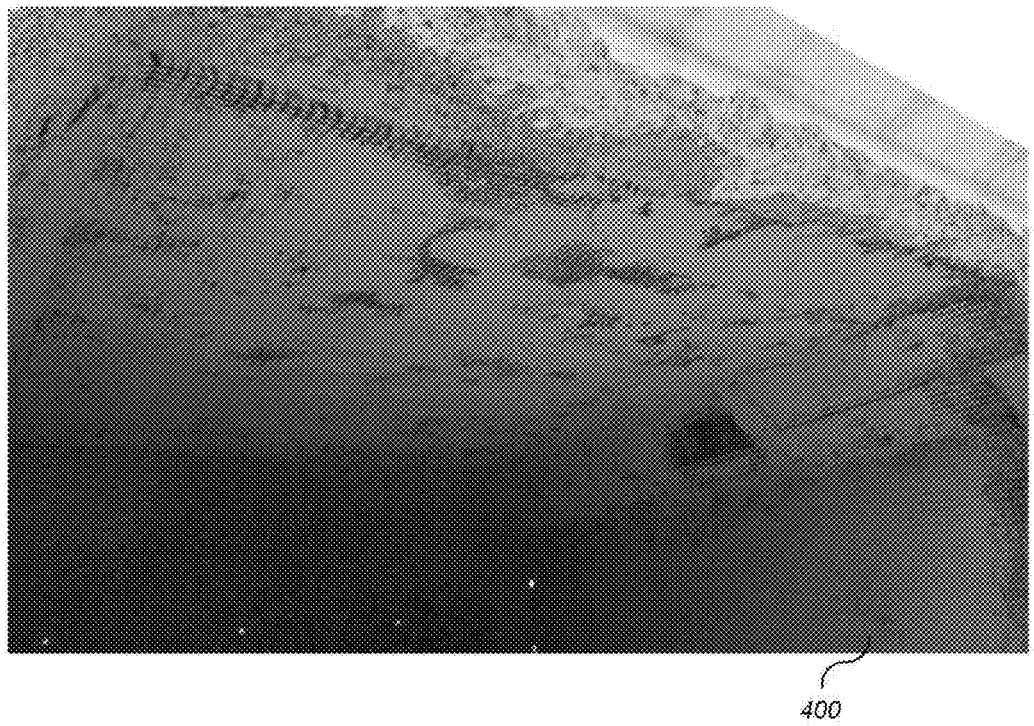
FIG. 12 is a view illustrating a lower portion of a slab to which the method of constructing textile grid reinforced shotcrete using an anchor pin according to one embodiment of the present invention is applied.
Figure 13:
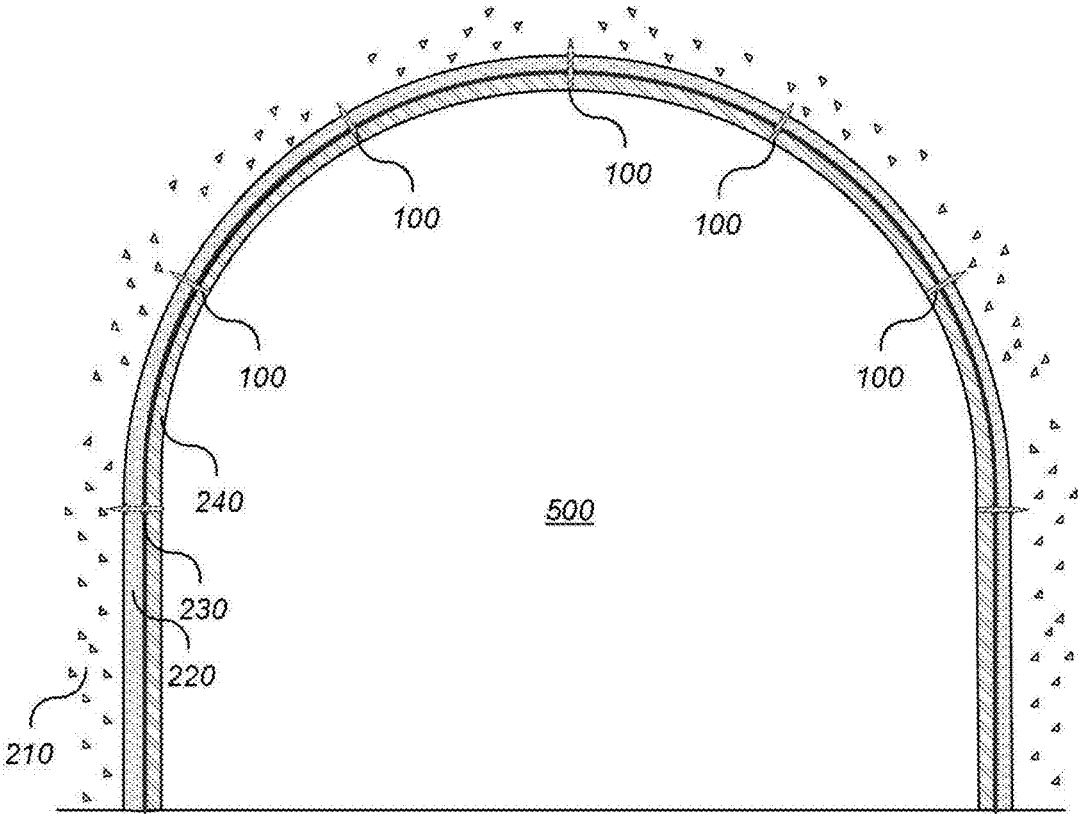
FIG. 13 is a view illustrating a lining of a tunnel to which the method of constructing textile grid reinforced shotcrete using an anchor pin according to one embodiment of the present invention is applied.

Meanwhile, FIG. 12 is a view illustrating a lower portion of a slab to which the method of constructing textile grid reinforced shotcrete using an anchor pin according to one embodiment of the present invention is applied, and FIG. 13 is a view illustrating a lining of a tunnel to which the method of constructing textile grid reinforced shotcrete using an anchor pin according to one embodiment of the present invention is applied.

In the method of constructing a textile grid reinforced shotcrete using an anchor pin according to one embodiment of the present invention, the concrete structure 210 to be repaired and reinforced may refer to a lower portion 400 of a slab or a wall shown in FIG. 12 or a lining of a tunnel 500 with a curved surface shown in FIG. 13, but the present invention is not limited thereto.

Accordingly, according to one embodiment of the present invention, the textile grid reinforcement is precisely disposed at a required position and prevented from moving due to a placing pressure when shotcrete is placed so that precise construction can be conducted, and thus durability and safety of the concrete structure can be increased. According to one embodiment of the present invention, the primary and secondary shotcrete can be constructed while the placing thicknesses thereof are visually checked, and thus precision of construction can be increased. Further, even when a structure with a curved surface, such as a lining of a tunnel, in addition to a lower portion of a slab or a wall are built, a textile grid reinforcement can be disposed and fixed to accurately correspond to the shape of the concrete structure.

According to the present invention, a textile grid reinforcement is precisely disposed at a required position and prevented from moving due to a placing pressure when shotcrete is placed so that construction can be conducted precisely, and thus durability and safety of the concrete structure can be increased.

According to the present invention, primary and secondary shotcrete are constructed while thicknesses of the placed shotcrete are visually checked, and thus precision of construction can be increased.

According to the present invention, even when a structure having a curved surface, such as a lining of a tunnel, in addition to a lower portion of a slab and a wall are constructed, a textile grid reinforcement can be disposed and fixed to accurately correspond to a shape of the concrete structure.

The above description of the present invention is only exemplary, and it should be understood by those skilled in the art that the invention may be performed in other concrete forms without changing the technological scope and essential features. Therefore, the above-described embodiments should be considered as only examples in all aspects and not for purposes of limitation. For example, each component described as a single type may be realized in a distributed manner, and similarly, components that are described as being distributed may be realized in a coupled manner. The scope of the present invention is defined not by the detailed description but by the appended claims and encompasses all modifications or alterations derived from meanings, the scope, and equivalents of the appended claims.

What is claimed is:

1. A method of constructing textile grid reinforced shotcrete using an anchor pin, comprising:

(a) driving and fixing an anchor pin in and to a surface of a concrete structure to be repaired and reinforced at a predetermined driving thickness;

(b) placing primary shotcrete up to a lower separation node of a grid fixing part (130) of the anchor pin at a placing thickness of primary shotcrete;

(c) insertion-mounting a textile grid reinforcement in a groove formed between nodes of a grid fixing part of the anchor pin;

(d) placing secondary shotcrete up to an uppermost end of the anchor pin at a placing thickness of the secondary shotcrete; and (e) finishing an exposed surface and completing repair and reinforcement of the concrete structure, wherein the anchor pin comprises:

a driving part serving as a front end part and driven in the concrete structure to be repaired and reinforced at the predetermined driving thickness;

a middle body part that extends from an upper portion of the driving part in a cylindrical form so that the placing thickness of the primary shotcrete is checked;

an upper body part that extends from an upper portion of the middle body part in a cylindrical form so that the placing thickness of the secondary shotcrete is checked;

a driving depth limiting lateral node formed between the driving part and the middle body part to protrude in a ring shape and formed in a lateral direction to limit a driving depth of the driving part; and a grid fixing part comprising an upper separation node and a lower separation node that are formed between the middle body part and the upper body part to protrude in a ring shape, wherein a groove is formed between the upper separation node and the lower separation node in a lateral direction so that a textile grid reinforcement is insertion-mounted in the groove.

2. The method of constructing textile grid reinforced shotcrete using an anchor pin of claim 1, wherein, in operation (a), the anchor pin is driven and fixed using an air tacker.

3. The method of constructing textile grid reinforced shotcrete using an anchor pin of claim 2, wherein, before operation (a), the anchor pin corresponding to a thickness of entire shotcrete is selected and loaded in the air tacker.

4. The method of constructing textile grid reinforced shotcrete using an anchor pin of claim 1, wherein a driving number of anchor pins identical to the anchor pin is set based on a state and curvature of the concrete structure, a type of the textile grid reinforcement, and a thickness of shotcrete, and the anchor pins are driven at intervals of 20 cm.

5. The method of constructing textile grid reinforced shotcrete using an anchor pin of claim 1, wherein an entire length of the anchor pin and each of the driving thickness and the placing thicknesses are determined based on an entire construction thickness of the primary shotcrete and the secondary shotcrete.

6. The method of constructing textile grid reinforced shotcrete using an anchor pin of claim 1, wherein the anchor pin is formed of a non-corrosive steel material with strength sufficient to be driven in concrete.

7. The method of constructing textile grid reinforced shotcrete using an anchor pin of claim 1, wherein the anchor pin is integrally manufactured in a nail shape.

8. The method of constructing textile grid reinforced shotcrete using an anchor pin of claim 1, wherein the driving depth limiting lateral node and the grid fixing part of the anchor pin are formed in a form of a sleeve and fastened between the driving part and the middle body part and between the middle body part and the upper body part, respectively.

9. The method of constructing textile grid reinforced shotcrete using an anchor pin of claim 1, wherein the middle body part of the anchor pin is formed between the driving depth limiting lateral node and the lower separation node of the grid fixing part and serves as a reference part with which the placing thickness of the primary shotcrete is visually checked.

10. The method of constructing textile grid reinforced shotcrete using an anchor pin of claim 1, wherein the upper body part of the anchor pin is formed from the upper separation node of the grid fixing part to the uppermost end of the anchor pin and serves as a reference part with which the placing thickness of the secondary shotcrete is visually checked.

11. A concrete structure repaired and reinforced by the method of constructing textile grid reinforced shotcrete using an anchor pin according to claim 1.

* * * * *